US009008559B2

(12) United States Patent
Adachi et al.

(10) Patent No.: US 9,008,559 B2
(45) Date of Patent: Apr. 14, 2015

(54) FIXING DEVICE WITH MECHANISM CAPABLE OF HEATING BELT EFFECTIVELY AND IMAGE FORMING APPARATUS INCORPORATING SAME

(75) Inventors: Tomoya Adachi, Hyogo (JP); Shigeo Nanno, Kyoto (JP); Tomohiko Fujii, Hyogo (JP); Yutaka Naitoh, Hyogo (JP); Minoru Toyoda, Hyogo (JP); Hitoshi Fujiwara, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 164 days.

(21) Appl. No.: 13/597,957

(22) Filed: Aug. 29, 2012

(65) Prior Publication Data

US 2013/0064586 A1 Mar. 14, 2013

(30) Foreign Application Priority Data

Sep. 12, 2011 (JP) ..... 2011-198655

(51) Int. Cl.
*G03G 15/20* (2006.01)

(52) U.S. Cl.
CPC ..... *G03G 15/2007* (2013.01); *G03G 15/2017* (2013.01); *G03G 2215/2035* (2013.01); *G03G 2215/2003* (2013.01); *G03G 2215/0132* (2013.01)

(58) Field of Classification Search
CPC ..... G03G 15/2064; G03G 15/2067; G03G 15/2007; G03G 15/2017; G03G 2215/2003; G03G 2215/2035
USPC ..... 399/122, 328, 329
See application file for complete search history.

(56) References Cited

U.S. PATENT DOCUMENTS

| | | | | |
|---|---|---|---|---|
| 8,428,480 | B2 * | 4/2013 | Takenaka et al. | 399/67 |
| 8,655,244 | B2 * | 2/2014 | Hasegawa et al. | 399/329 |
| 2006/0210326 | A1 | 9/2006 | Takehara et al. | |
| 2006/0210327 | A1 | 9/2006 | Iwakura et al. | |
| 2006/0257176 | A1 | 11/2006 | Kawasaki et al. | |

(Continued)

FOREIGN PATENT DOCUMENTS

| | | |
|---|---|---|
| CN | 101995802 A | 3/2011 |
| JP | 2005-092080 | 4/2005 |

(Continued)

OTHER PUBLICATIONS

Chinese Office Action issued Oct. 22, 2014 for Chinese Patent Application No. 201210324901.7.

*Primary Examiner* — David Gray
*Assistant Examiner* — Carla Therrien
(74) *Attorney, Agent, or Firm* — Harness, Dickey & Pierce, P.L.C.

(57) ABSTRACT

A fixing device includes an endless belt and an opposed rotary body contacting an outer circumferential surface of the belt. A nip formation pad contacting a first part of an inner circumferential surface of the belt presses against the opposed rotary body via the belt to form a fixing nip between the belt and the opposed rotary body through which a recording medium bearing a toner image is conveyed. A heat conductor disposed opposite a second part of the inner circumferential surface of the belt not contacted by the nip formation pad is interposed between a heater and the belt to conduct heat from the heater to the belt. A reflector disposed inside the loop formed by the belt reflects light from the heater toward the heat conductor. The reflector and the heat conductor surround the heater.

19 Claims, 5 Drawing Sheets

(56) References Cited

U.S. PATENT DOCUMENTS

| | | | | |
|---|---|---|---|---|
| 2007/0110458 | A1 | 5/2007 | Inoue et al. | |
| 2007/0147859 | A1 | 6/2007 | Adachi et al. | |
| 2007/0285701 | A1 | 12/2007 | Ohta et al. | |
| 2008/0006166 | A1 | 1/2008 | Ohkubo et al. | |
| 2008/0056783 | A1 | 3/2008 | Yamamoto et al. | |
| 2008/0152378 | A1 | 6/2008 | Yamashita et al. | |
| 2008/0193162 | A1 | 8/2008 | Yamazoe et al. | |
| 2008/0310893 | A1 | 12/2008 | Adachi et al. | |
| 2009/0010680 | A1 | 1/2009 | Nanno | |
| 2009/0010688 | A1 | 1/2009 | Takahashi et al. | |
| 2009/0014288 | A1 | 1/2009 | Miyazaki et al. | |
| 2009/0022516 | A1 | 1/2009 | Ohta et al. | |
| 2009/0060572 | A1 | 3/2009 | Naitoh et al. | |
| 2009/0074440 | A1 | 3/2009 | Nanno et al. | |
| 2009/0110449 | A1 | 4/2009 | Saito et al. | |
| 2009/0129830 | A1 | 5/2009 | Adachi et al. | |
| 2009/0129836 | A1 | 5/2009 | Sakaya et al. | |
| 2009/0162772 | A1 | 6/2009 | Fuwa et al. | |
| 2010/0034548 | A1 | 2/2010 | Naitoh et al. | |
| 2010/0092221 | A1 | 4/2010 | Shinshi et al. | |
| 2010/0232848 | A1 | 9/2010 | Naitoh | |
| 2010/0239337 | A1* | 9/2010 | Muramatsu et al. | 399/329 |
| 2011/0008082 | A1 | 1/2011 | Nanno | |
| 2011/0020018 | A1* | 1/2011 | Takenaka et al. | 399/33 |
| 2011/0026944 | A1 | 2/2011 | Naitoh | |
| 2011/0026961 | A1* | 2/2011 | Ohta et al. | 399/69 |
| 2011/0044734 | A1* | 2/2011 | Shimokawa et al. | 399/322 |
| 2011/0058864 | A1* | 3/2011 | Fujimoto et al. | 399/329 |
| 2011/0085832 | A1* | 4/2011 | Hasegawa et al. | 399/329 |
| 2011/0142495 | A1 | 6/2011 | Nanno | |
| 2011/0217057 | A1* | 9/2011 | Yoshinaga et al. | 399/33 |
| 2012/0008971 | A1* | 1/2012 | Lee et al. | 399/69 |
| 2012/0020681 | A1 | 1/2012 | Naitoh et al. | |
| 2012/0177422 | A1 | 7/2012 | Nanno et al. | |
| 2012/0275834 | A1* | 11/2012 | Naitoh et al. | 399/329 |

FOREIGN PATENT DOCUMENTS

| | | |
|---|---|---|
| JP | 2007-192846 | 8/2007 |
| JP | 2009-015141 | 1/2009 |
| JP | 2010-096823 | 4/2010 |
| JP | 2010-243860 A | 10/2010 |
| JP | 2011-022430 A | 2/2011 |

* cited by examiner

FIXING DEVICE WITH MECHANISM CAPABLE OF HEATING BELT EFFECTIVELY AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2011-198655, filed on Sep. 12, 2011, in the Japanese Patent Office, the entire disclosure of which is hereby incorporated by reference herein.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may employ an endless fixing belt having a heat capacity smaller than that of a fixing roller to shorten a warm-up time required to warm up the fixing belt to a given fixing temperature at which the toner image is fixed on the recording medium and thereby save energy. FIG. 1 illustrates a fixing device 90 incorporating an endless fixing belt 91. As shown in FIG. 1, a pressurization assembly 97 presses a pressing roller 92 against a nip formation pad 93 via the fixing belt 91 to form a fixing nip N between the pressing roller 92 and the fixing belt 91. Inside a loop formed by the fixing belt 91 are a reinforcement 94 that supports the nip formation pad 93, a heat conductor 96 disposed opposite the inner circumferential surface of the fixing belt 91, and a heater 95 disposed opposite the fixing belt 91 via the heat conductor 96. A temperature sensor 98 is disposed opposite the outer circumferential surface of the fixing belt 91 to detect the temperature of the fixing belt 91.

As the fixing device 90 is powered on, the heater 95 heats the heat conductor 96 which in turn heats the fixing belt 91 and at the same time the pressing roller 92 rotates clockwise in FIG. 1, which in turn rotates the fixing belt 91 counterclockwise in FIG. 1. As a recording medium P bearing a toner image T is conveyed through the fixing nip N formed between the pressing roller 92 and the fixing belt 91, the fixing belt 91 and the pressing roller 92 apply heat and pressure to the recording medium P, melting and fixing the toner image T on the recording medium P.

As the pressing roller 92 rotates the fixing belt 91, it stretches the fixing belt 91 toward the fixing nip N, bringing an upstream portion of the fixing belt 91 disposed upstream from the fixing nip N in the direction of rotation of the fixing belt 91 into contact with the heat conductor 96 and thereby facilitating heat conduction from the heat conductor 96 to the fixing belt 91. Conversely, a downstream portion of the fixing belt 91 disposed downstream from the fixing nip N in the direction of rotation of the fixing belt 91 is isolated from the heat conductor 96, decreasing heat conduction from the heat conductor 96 to the fixing belt 91. That is, a downstream portion of the heat conductor 96 disposed opposite the downstream portion of the fixing belt 91 is unnecessarily heated by the heater 95. Accordingly, the heat conductor 96 spanning substantially the entire inner circumferential surface of the fixing belt 91 decreases heating efficiency for heating the fixing belt 91, obstructing shortening of the warm-up time of the fixing belt 91 and saving energy.

To address this problem, the downstream portion of the heat conductor 96 disposed opposite the downstream portion of the fixing belt 91 may have a decreased thickness or a plurality of through-holes that decreases heat capacity of the downstream portion of the heat conductor 96, thus shortening the warm-up time of the fixing belt 91 and saving energy. However, even with the decreased thickness or the through-holes, the downstream portion of the heat conductor 96 may still draw heat from the heater 95. Additionally, producing the heat conductor 96 having different thicknesses and the through-holes may increase manufacturing costs.

Alternatively, a heat conduction roller having a diameter smaller than that of the heat conductor 96 and therefore having a decreased heat capacity may partially contact the inner circumferential surface of the fixing belt 91. As a heater disposed inside the heat conduction roller heats the heat conduction roller, the heat conduction roller heats the fixing belt 91. However, heat may dissipate from the heat conduction roller at a portion thereof isolated from the fixing belt 91, decreasing heating efficiency for heating the fixing belt 91.

SUMMARY OF THE INVENTION

At least one embodiment may provide a fixing device that includes an endless belt formed into a loop and rotatable in a predetermined direction of rotation and an opposed rotary body contacting an outer circumferential surface of the belt and rotatable in a direction counter to the direction of rotation of the belt. A nip formation pad contacting a first part of an inner circumferential surface of the belt presses against the opposed rotary body via the belt to form a fixing nip between the belt and the opposed rotary body through which a recording medium bearing a toner image is conveyed. A heater is disposed inside the loop formed by the belt. A heat conductor disposed opposite a second part of the inner circumferential surface of the belt not contacted by the nip formation pad is interposed between the heater and the belt to conduct heat from the heater to the belt. A reflector disposed inside the loop formed by the belt reflects light from the heater toward the heat conductor. The reflector and the heat conductor surround the heater.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
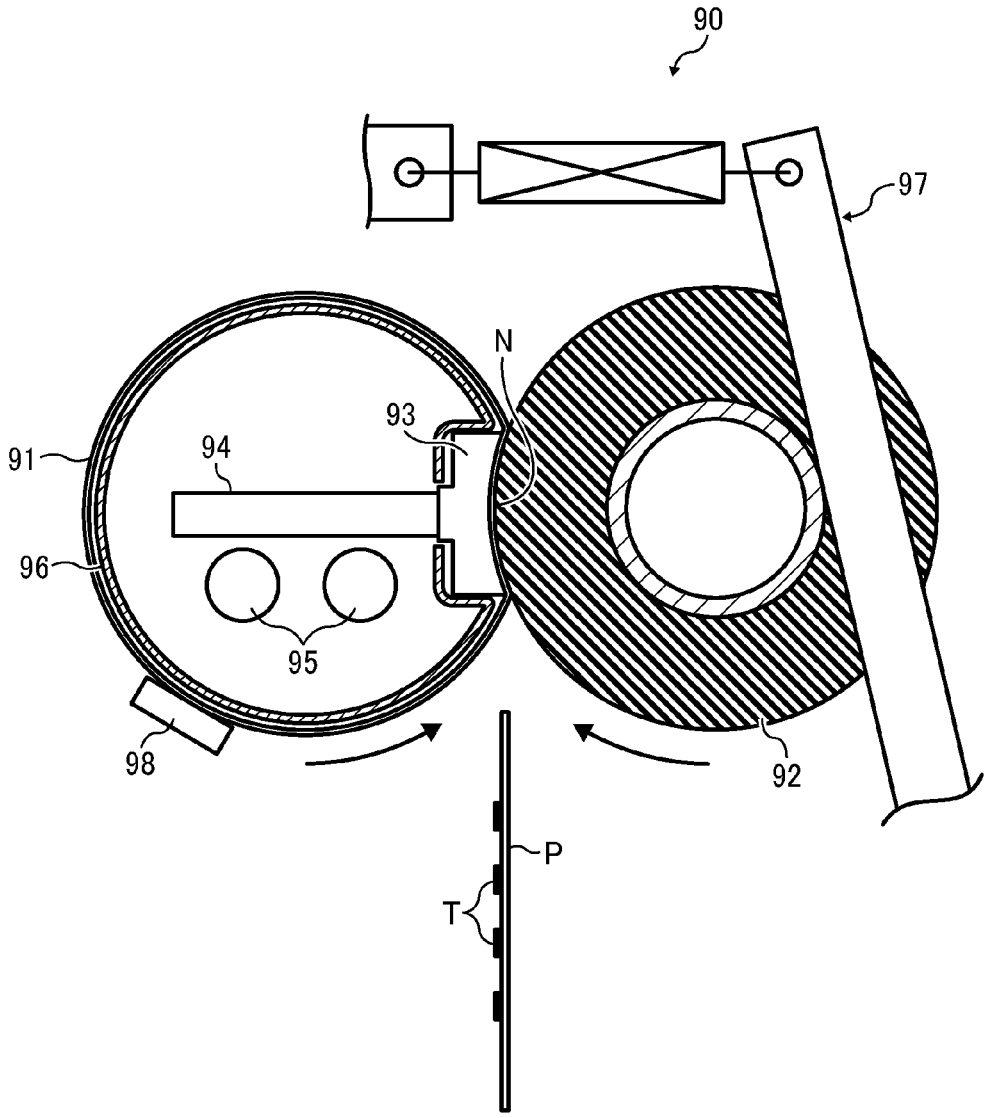
FIG. 1 RELATED ART
FIG. 1 is a schematic vertical sectional view of a related-art fixing device.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
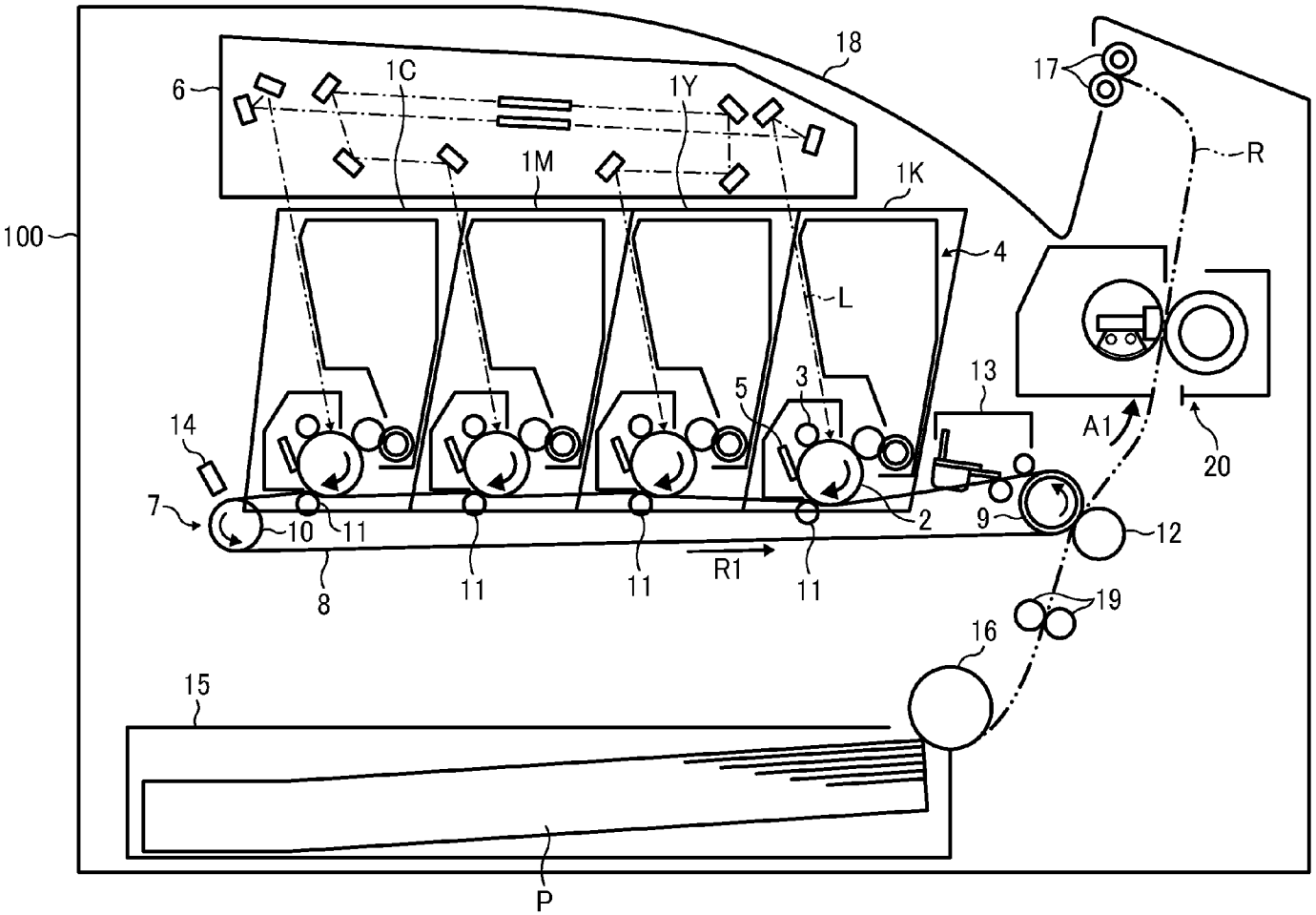
FIG. 2 is a schematic vertical sectional view of an image forming apparatus according to an example embodiment of the present invention.

Referring now to the drawings, wherein like reference numerals designate identical or corresponding parts throughout the several views, particularly to FIG. 2, an image forming apparatus 100 according to an example embodiment is explained.

FIG. 2 is a schematic vertical sectional view of the image forming apparatus 100. The image forming apparatus 100 may be a copier, a facsimile machine, a printer, a multifunction printer having at least one of copying, printing, scanning, plotter, and facsimile functions, or the like. According to this example embodiment, the image forming apparatus 100 is a color printer for forming a color toner image on a recording medium by electrophotography.

Referring to FIG. 2, the following describes the structure of the image forming apparatus 100.

The image forming apparatus 100 includes four process units 1K, 1Y, 1M, and 1C detachably attached to the image forming apparatus 100. Although the process units 1K, 1Y, 1M, and 1C contain black, yellow, magenta, and cyan toners that form black, yellow, magenta, and cyan toner images, respectively, resulting in a color toner image, they have an identical structure. Hence, the following describes the structure of one of them, that is, the process unit 1K that forms a black toner image.

For example, the process unit 1K includes a drum-shaped photoconductor 2 serving as an image carrier that carries an electrostatic latent image and a resultant black toner image; a charging roller 3 serving as a charger that charges an outer circumferential surface of the photoconductor 2; a development device 4 serving as a development unit that supplies developer (e.g., black toner) to the electrostatic latent image formed on the outer circumferential surface of the photoconductor 2, thus visualizing the electrostatic latent image into a black toner image with the black toner; and a cleaning blade 5 serving as a cleaner that cleans the outer circumferential surface of the photoconductor 2. Although reference numerals are omitted in FIG. 2, each of the process units 1Y, 1M, and 1C includes the photoconductor 2, the charging roller 3, the development device 4, and the cleaning blade 5 described above.

The tubular photoconductor 2 is a photoconductive drum that rotates at a given linear speed. The charging roller 3 contacting the photoconductor 2 is driven and rotated in accordance with rotation of the photoconductor 2. As a high voltage power supply applies a direct current bias or a superimposed bias of direct current and alternating current to the charging roller 3, the charging roller 3 uniformly charges the outer circumferential surface of the photoconductor 2 at a substantially uniform potential. As the high voltage power supply applies a given development bias to the development device 4 containing black toner, the development device 4 visualizes the electrostatic latent image formed on the photoconductor 2 as a black toner image. According to this example embodiment, the development device 4 accommodates one-component developer containing toner particles. Alternatively, the development device 4 may accommodate two-component developer containing toner particles and carrier particles. The cleaning blade 5 contacting the photoconductor 2, as the photoconductor 2 rotates, scrapes residual toner off the photoconductor 2. Alternatively, instead of the cleaning blade 5, a development roller incorporated in the development device 4 may remove residual toner from the photoconductor 2. Yet alternatively, various known cleaners may be employed.

Above the process units 1K, 1Y, 1M, and 1C is an exposure device 6 that exposes the outer circumferential surface of the photoconductor 2, thus forming an electrostatic latent image thereon. For example, the exposure device 6 includes a laser beam scanner and a light-emitting diode (LED) using laser diode. The exposure device 6 emits a laser beam L onto the outer circumferential surface of the photoconductor 2 according to image data sent from an external device such as a client computer.

Below the process units 1K, 1Y, 1M, and 1C is a transfer unit 7 that accommodates an endless intermediate transfer belt 8 serving as a transferor, a driving roller 9, a tension roller 10, four primary transfer rollers 11, and a belt cleaner 13. For example, the intermediate transfer belt 8 is stretched over the driving roller 9 and the tension roller 10 that support the intermediate transfer belt 8. As the driving roller 9 rotates counterclockwise in FIG. 2, the intermediate transfer belt 8 rotates counterclockwise in FIG. 2 in a rotation direction R1. Springs attached to both lateral ends of the tension roller 10 in an axial direction thereof, respectively, press the tension roller 10 against the intermediate transfer belt 8, thus exerting a given tension to the intermediate transfer belt 8.

Inside a loop formed by the intermediate transfer belt 8 and opposite the four photoconductors 2 are the four primary transfer rollers 11 serving as primary transferors that transfer the black, yellow, magenta, and cyan toner images formed on the photoconductors 2, respectively, onto an outer circumferential surface of the intermediate transfer belt 8. The primary transfer rollers 11 contact an inner circumferential surface of the intermediate transfer belt 8 and press the intermediate transfer belt 8 against the photoconductors 2 at opposed positions where the primary transfer rollers 11 are disposed opposite the photoconductors 2, respectively, via the intermediate transfer belt 8, thus forming primary transfer nips between the photoconductors 2 and the intermediate transfer belt 8 where the black, yellow, magenta, and cyan toner images formed on the photoconductors 2 are primarily transferred onto the intermediate transfer belt 8 to form a color toner image thereon. The primary transfer rollers 11 are connected to a power supply that applies a given direct current voltage and/or alternating current voltage thereto.

Opposite the driving roller 9 is a secondary transfer roller 12 serving as a secondary transferor that transfers the color toner image formed on the intermediate transfer belt 8 onto a recording medium P. The secondary transfer roller 12 contacts the outer circumferential surface of the intermediate transfer belt 8 and presses the intermediate transfer belt 8 against the driving roller 9, thus forming a secondary transfer nip between the secondary transfer roller 12 and the intermediate transfer belt 8 where the color toner image formed on the intermediate transfer belt 8 is transferred onto a recording medium P. Similar to the primary transfer rollers 11, the secondary transfer roller 12 is connected to the power supply that applies a given direct current voltage and/or alternating current voltage thereto.

The belt cleaner 13, disposed opposite the outer circumferential surface of the intermediate transfer belt 8 and downstream from the secondary transfer nip in the rotation direction R1 of the intermediate transfer belt 8, cleans the outer circumferential surface of the intermediate transfer belt 8. A toner mark sensor 14, disposed opposite the tension roller 10 via the intermediate transfer belt 8, is a regular reflection sensor or a dispersion sensor incorporating a light emitting element and a light receiving element that measures the toner density and position of the black, yellow, magenta, and cyan toner images superimposed on the intermediate transfer belt 8, thus adjusting the toner density and superimposing of the black, yellow, magenta, and cyan toner images.

In a lower portion of the image forming apparatus 100 are a paper tray 15 that contains a plurality of recording media P (e.g., paper and overhead projector (OHP) transparencies) and a feed roller 16 that picks up and feeds an uppermost recording medium P from the paper tray 15. In an upper portion of the image forming apparatus 100 are an output roller pair 17 that discharges the recording medium P onto an outside of the image forming apparatus 100 and an output tray 18 that receives and stocks the recording medium P discharged by the output roller pair 17. The recording medium P fed by the feed roller 16 is conveyed upward through a conveyance path R that extends from the paper tray 15 to the output roller pair 17 through the secondary transfer nip formed between the secondary transfer roller 12 and the intermediate transfer belt 8. The conveyance path R is provided with a registration roller pair 19 located below the secondary transfer nip formed between the secondary transfer roller 12 and the intermediate transfer belt 8, that is, upstream from the secondary transfer nip in a recording medium conveyance direction A1. The registration roller pair 19 feeds the recording medium P conveyed from the feed roller 16 toward the secondary transfer nip. The conveyance path R is further provided with a fixing device 20 located above the secondary transfer nip, that is, downstream from the secondary transfer nip in the recording medium conveyance direction A1. The fixing device 20 fixes the color toner image on the recording medium P.

Referring to FIG. 2, the following describes an operation of the image forming apparatus 100 having the structure described above to form a color toner image on a recording medium P.

As a print job starts, a driver drives and rotates the photoconductors 2 of the process units 1K, 1Y, 1M, and 1C, respectively, clockwise in FIG. 2. The charging rollers 3 uniformly charge the outer circumferential surface of the respective photoconductors 2 at a given polarity. The exposure device 6 emits laser beams L onto the charged outer circumferential surface of the respective photoconductors 2 according to black, yellow, magenta, and cyan image data contained in image data sent from the external device, respectively, thus forming electrostatic latent images thereon. The development devices 4 supply black, yellow, magenta, and cyan toners to the electrostatic latent images formed on the photoconductors 2, visualizing the electrostatic latent images into black, yellow, magenta, and cyan toner images, respectively.

As the driving roller 9 is driven and rotated counterclockwise in FIG. 2, the driving roller 9 drives and rotates the intermediate transfer belt 8 counterclockwise in FIG. 2 in the rotation direction R1. As a power supply applies a constant voltage or a constant current control voltage having a polarity opposite a polarity of the charged black, yellow, magenta, and cyan toners to the primary transfer rollers 11, a transfer electric field is created at the primary transfer nips formed between the primary transfer rollers 11 and the photoconductors 2, respectively. Accordingly, the black, yellow, magenta, and cyan toner images formed on the photoconductors 2, respectively, are primarily transferred onto the intermediate transfer belt 8 successively by the transfer electric field created at the respective primary transfer nips, in such a manner that the black, yellow, magenta, and cyan toner images are superimposed on a same position on the intermediate transfer belt 8. Consequently, a color toner image is formed on the intermediate transfer belt 8. After the primary transfer of the black, yellow, magenta, and cyan toner images from the photoconductors 2 onto the intermediate transfer belt 8, the cleaning blades 5 remove residual toner not transferred onto the intermediate transfer belt 8 and therefore remaining on the photoconductors 2 therefrom.

On the other hand, as the print job starts, the feed roller 16 is driven and rotated to feed a recording medium P from the paper tray 15 toward the registration roller pair 19 through the conveyance path R. The registration roller pair 19 feeds the recording medium P to the secondary transfer nip formed between the secondary transfer roller 12 and the intermediate transfer belt 8 at a time when the color toner image formed on the intermediate transfer belt 8 reaches the secondary transfer nip. The secondary transfer roller 12 is applied with a transfer voltage having a polarity opposite a polarity of the charged black, yellow, magenta, and cyan toners of the black, yellow, magenta, and cyan toner images constituting the color toner image formed on the intermediate transfer belt 8, thus creating a transfer electric field at the secondary transfer nip. Accordingly, the black, yellow, magenta, and cyan toner images constituting the color toner image are secondarily transferred from the intermediate transfer belt 8 collectively onto the recording medium P by the transfer electric field created at the secondary transfer nip. After the secondary transfer of the color toner image from the intermediate transfer belt 8 onto the recording medium P, the belt cleaner 13 removes residual toner not transferred onto the recording medium P and therefore remaining on the intermediate transfer belt 8 therefrom. Then, the recording medium P bearing the color toner image is conveyed to the fixing device 20 that fixes the color toner image on the recording medium P. Thereafter, as the recording medium P bearing the fixed color toner image reaches the output roller pair 17, the output roller pair 17 discharges the recording medium P onto the output tray 18.

The above describes the image forming operation of the image forming apparatus 100 to form the color toner image on the recording medium P. Alternatively, the image forming apparatus 100 may form a monochrome toner image by using any one of the four process units 1K, 1Y, 1M, and 1C or may form a bicolor or tricolor toner image by using two or three of the process units 1K, 1Y, 1M, and 1C.

Figure 3:
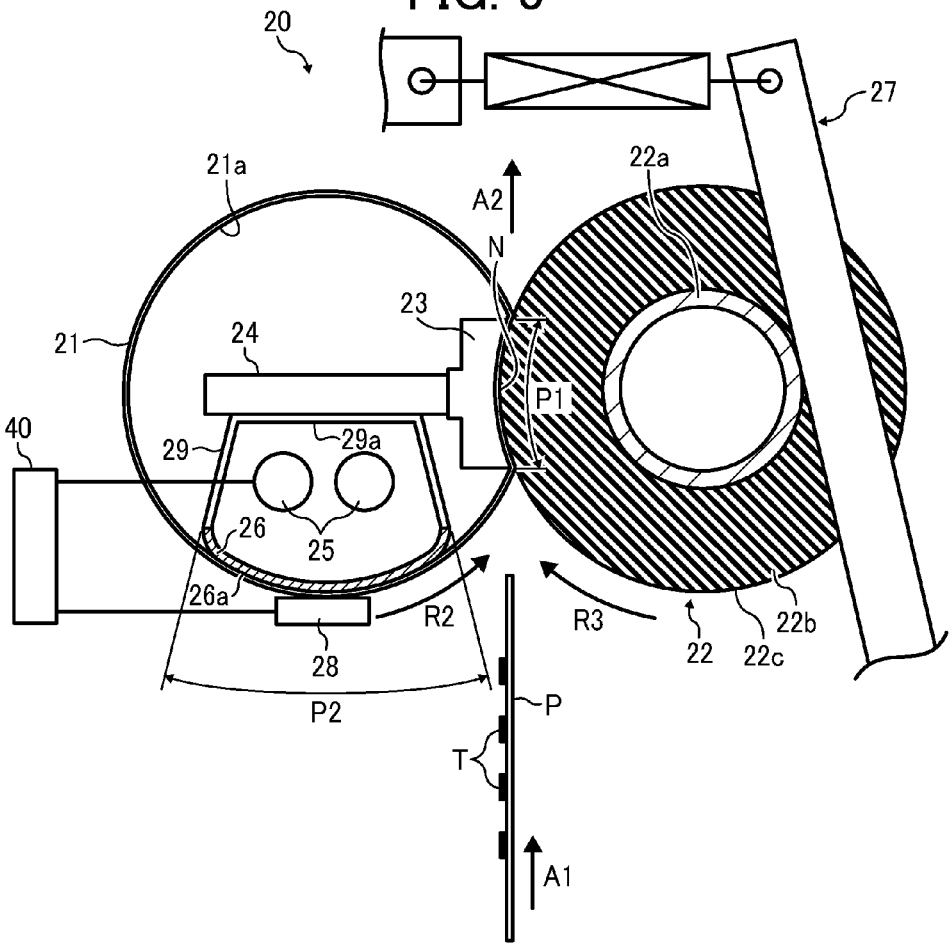
FIG. 3 is a vertical sectional view of a fixing device incorporated in the image forming apparatus shown in FIG. 2.

Referring to FIG. 3, the following describes a construction of the fixing device 20 installed in the image forming apparatus 100 described above. FIG. 3 is a vertical sectional view of the fixing device 20.

As shown in FIG. 3, the fixing device 20 (e.g., a fuser) includes the fixing belt 21 serving as an endless belt formed into a loop and rotatable in a rotation direction R2; a pressing roller 22 serving as an opposed rotary body disposed opposite an outer circumferential surface of the fixing belt 21 and rotatable in a rotation direction R3 counter to the rotation direction R2 of the fixing belt 21; a nip formation pad 23 pressing against the pressing roller 22 via the fixing belt 21 to form a fixing nip N between the fixing belt 21 and the pressing roller 22; a reinforcement 24 disposed inside the loop formed by the fixing belt 21 and contacting and supporting the nip formation pad 23; a heater 25 disposed inside the loop formed by the fixing belt 21; a heat conductor 26 disposed inside the loop formed by the fixing belt 21 and conducting heat from the heater 25 to the fixing belt 21; a reflector 29 disposed inside the loop formed by the fixing belt 21 and reflecting light (e.g., infrared rays) from the heater 25 toward the heat conductor 26; a pressurization assembly 27 contacting the pressing roller 22 to press the pressing roller 22 against the nip formation pad 23 via the fixing belt 21; and a temperature sensor 28 disposed opposite the outer circumferential surface of the fixing belt 21 and detecting the temperature of the fixing belt 21.

A detailed description is now given of a construction of the pressing roller 22.

The pressing roller 22 having a diameter in a range of from about 20 mm to about 40 mm is constructed of a hollow metal core 22*a*; an elastic layer 22*b* coating the metal core 22*a*; and a thin, surface release layer 22*c* coating the elastic layer 22*b*. For example, the elastic layer 22*b* is made of silicone rubber foam, silicone rubber, fluoro rubber, or the like. The release layer 22*c* is made of tetrafluoroethylene-perfluoroalkyl vinyl ether copolymer (PFA), polytetrafluoroethylene (PTFE), or the like. Alternatively, the release layer 22*c* may be omitted or a heater such as a halogen heater may be located inside the pressing roller 22.

The pressurization assembly 27 presses the pressing roller 22 against the nip formation pad 23 via the fixing belt 21 to form the fixing nip N between the pressing roller 22 and the fixing belt 21. As a driver drives and rotates the pressing roller 22 clockwise in FIG. 3 in the rotation direction R3, the pressing roller 22 pressed against the fixing belt 21 in turn rotates the fixing belt 21 counterclockwise in the rotation direction R2.

A detailed description is now given of a construction of the fixing belt 21.

The fixing belt 21 is a thin, flexible endless belt or film having a thickness not greater than about 500 micrometers.

The fixing belt 21 is constructed of a base layer constituting an inner circumferential surface 21*a;* an elastic layer coating the base layer, and a surface release layer coating the elastic layer. The base layer having a thickness in a range of from about 30 micrometers to about 100 micrometers is made of a metal material such as nickel, stainless steel, or the like or a resin material such as polyimide or the like. The elastic layer having a thickness in a range of from about 100 micrometers to about 300 micrometers is made of a rubber material such as silicone rubber, silicone rubber foam, fluoro rubber, or the like. The elastic layer eliminates or reduces slight surface asperities of the fixing belt 21 at the fixing nip N formed between the fixing belt 21 and the pressing roller 22. Accordingly, heat is uniformly conducted from the fixing belt 21 to a toner image T on a recording medium P, minimizing formation of a rough image such as an orange peel image.

The release layer, having a thickness in a range of from about 5 micrometers to about 50 micrometers, is made of PFA, PTFE, polyimide (PI), polyamideimide (PAI), polyetherimide (PEI), polyether sulfide (PES), polyether ether ketone (PEEK), or the like. The fixing belt 21 has a loop diameter in a range of from about 15 mm to about 120 mm. According to this example embodiment, the fixing belt 21 has a loop diameter of about 30 mm.

Although not shown, a first stay, a second stay, and a sheet member are situated inside the loop formed by the fixing belt 21 in addition to the nip formation pad 23, the reinforcement 24, the heater 25, the heat conductor 26, and the reflector 29 shown in FIG. 3.

A detailed description is now given of a construction of the heater 25.

The heater 25 is a halogen heater, a carbon heater, or the like. A power supply situated inside the image forming apparatus 100 supplies power to the heater 25 so that the heater 25 heats the fixing belt 21 via the heat conductor 26. A controller 40, that is, a central processing unit (CPU), provided with a random-access memory (RAM) and a read-only memory (ROM), for example, operatively connected to the temperature sensor 28 controls the heater 25 based on the temperature of the fixing belt 21 detected by the temperature sensor 28 so as to adjust the temperature of the fixing belt 21 to a desired fixing temperature. According to this example embodiment, the temperature sensor 28 is a contact sensor that detects the temperature of the fixing belt 21 by contacting the fixing belt 21. Alternatively, the temperature sensor 28 may be a non-contact sensor that detects the temperature of the fixing belt 21 without contacting the fixing belt 21.

A detailed description is now given of a construction of the nip formation pad 23.

The nip formation pad 23 extends in an axial direction of the fixing belt 21 and the pressing roller 22 and is stationarily supported by the reinforcement 24. The nip formation pad 23 presses against the pressing roller 22 via the fixing belt 21, forming the fixing nip N between the fixing belt 21 and the pressing roller 22.

A detailed description is now given of a construction of the heat conductor 26.

The heat conductor 26 conducts heat from the heater 25 to the fixing belt 21. The heat conductor 26 is made of a conductive metal material such as aluminum, iron, stainless steel, or the like. The heat conductor 26 has a thickness not greater than about 0.2 mm to enhance heating efficiency for heating the fixing belt 21. A lubricant such as fluorine grease or silicone oil may be applied between an outer circumferential surface of the heat conductor 26 and the inner circumferential surface of the fixing belt 21 to decrease wear of the heat conductor 26 and the fixing belt 21 due to friction between the heat conductor 26 and the fixing belt 21 sliding over the heat conductor 26.

A detailed description is now given of a construction of the reflector 29.

The reflector 29 reflects light (e.g., infrared rays) from the heater 25 toward the heat conductor 26. An inner face 29a of the reflector 29 disposed opposite the heater 25 is coated with high intensity aluminum or silver having an infrared ray reflectance not smaller than about 90 percent.

Referring to FIGS. 2 and 3, the following describes an operation of the fixing device 20 having the construction described above to fix a toner image T on a recording medium P.

As a user turns on a power switch of the image forming apparatus 100, the power supply supplies power to the heater 25 and the driver drives and rotates the pressing roller 22 clockwise in FIG. 3 in the rotation direction R3 which in turn rotates the fixing belt 21 counterclockwise in the rotation direction R2 by friction therebetween.

Thereafter, a recording medium P is conveyed from the paper tray 15 to the secondary transfer nip formed between the secondary transfer roller 12 and the intermediate transfer belt 8 where a toner image T is transferred from the intermediate transfer belt 8 onto the recording medium P. A guide plate guides the recording medium P bearing the unfixed toner image T in the recording medium conveyance direction A1 to the fixing nip N formed between the fixing belt 21 and the pressing roller 22 pressed against the fixing belt 21.

The fixing belt 21 heated by the heater 25 heats the recording medium P and at the same time the pressing roller 22 pressed against the fixing belt 21 and the fixing belt 21 together exert pressure to the recording medium P, thus fixing the toner image T on the recording medium P. Thereafter, the recording medium P bearing the fixed toner image T is discharged from the fixing nip N and conveyed in a recording medium conveyance direction A2 to an outside of the fixing device 20. Thus, a series of fixing processes performed by the fixing device 20 is completed.

Referring to FIGS. 3 to 8, the following describes a configuration of the fixing device 20 in detail.

As shown in FIG. 3, the heat conductor 26 is not disposed opposite the entire inner circumferential surface of the fixing belt 21. That is, the heat conductor 26 is disposed opposite a second part P2 of the inner circumferential surface of the fixing belt 21 different from a first part P1 thereof contacted by the nip formation pad 23. The heat conductor 26 may be in contact with or isolation from the inner circumferential surface of the fixing belt 21. For example, the heat conductor 26 is disposed upstream from the fixing nip N in the rotation direction R2 of the fixing belt 21. Accordingly, as the fixing belt 21 rotates in the rotation direction R2, the fixing belt 21 comes into contact with the heat conductor 26 in an increased area where the heat conductor 26 conducts heat from the heater 25 to the fixing belt 21 directly. For example, as the fixing belt 21 rotates in the rotation direction R2, the fixing belt 21 is stretched toward the fixing nip N and an orbit of the rotating fixing belt 21 moves toward the heat conductor 26, bringing the fixing belt 21 into contact with the heat conductor 26 or increasing a contact area where the heat conductor 26 contacts the fixing belt 21. For example, as the fixing belt 21 rotates in the rotation direction R2, the inner circumferential surface of the fixing belt 21 contacts an outer surface 26*a* of the heat conductor 26 in a desired area of about 60 percent or more of the entire area of the outer surface 26*a*.

The reflector 29 is folded to create an opening that faces the heat conductor 26 and extends in the axial direction of the fixing belt 21. Both longitudinal edges of the reflector 29 in the rotation direction R2 of the fixing belt 21 contact both longitudinal edges of the heat conductor 26, respectively. The heater 25 is situated in space enclosed with the reflector 29 and the heat conductor 26. That is, the heater 25 is cased with the reflector 29 and the heat conductor 26. The heater 25 may be cased with the reflector 29 and the heat conductor 26 entirely or partially. For example, both longitudinal edges of the reflector 29 may partially contact both longitudinal edges of the heat conductor 26 with a partial interval therebetween or may overlap both longitudinal edges of the heat conductor 26 across an interval therebetween.

The reflector 29 is disposed opposite the heater 25 in an outer circumferential area of the heater 25 of not smaller than about 180 degrees to maximize an amount of heat, that is, infrared rays, from the heater 25 reflected by the reflector 29 toward the heat conductor 26. The reflector 29 is attached to the reinforcement 24.

Figure 4:
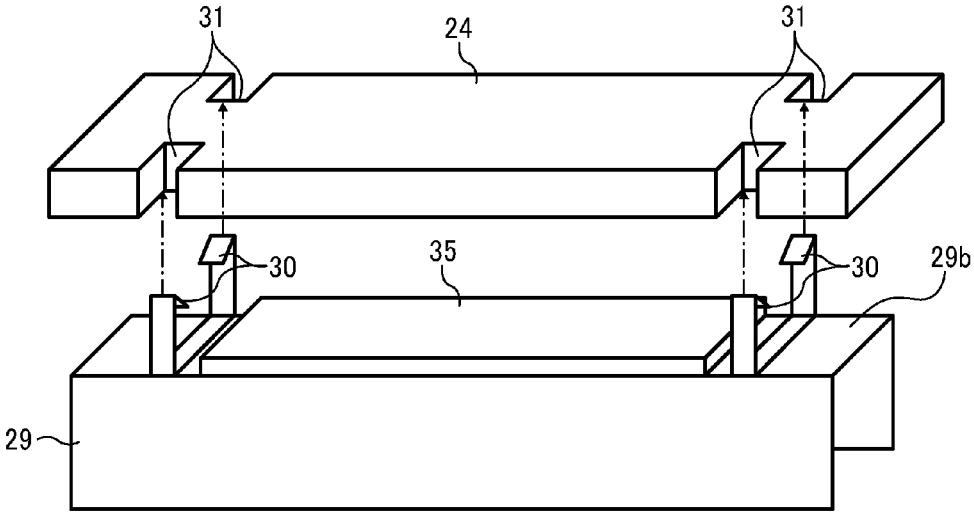
FIG. 4 is a perspective view of a reflector and a reinforcement incorporated in the fixing device shown in FIG. 3 illustrating a first method of attaching the reflector to the reinforcement.
Figure 5:
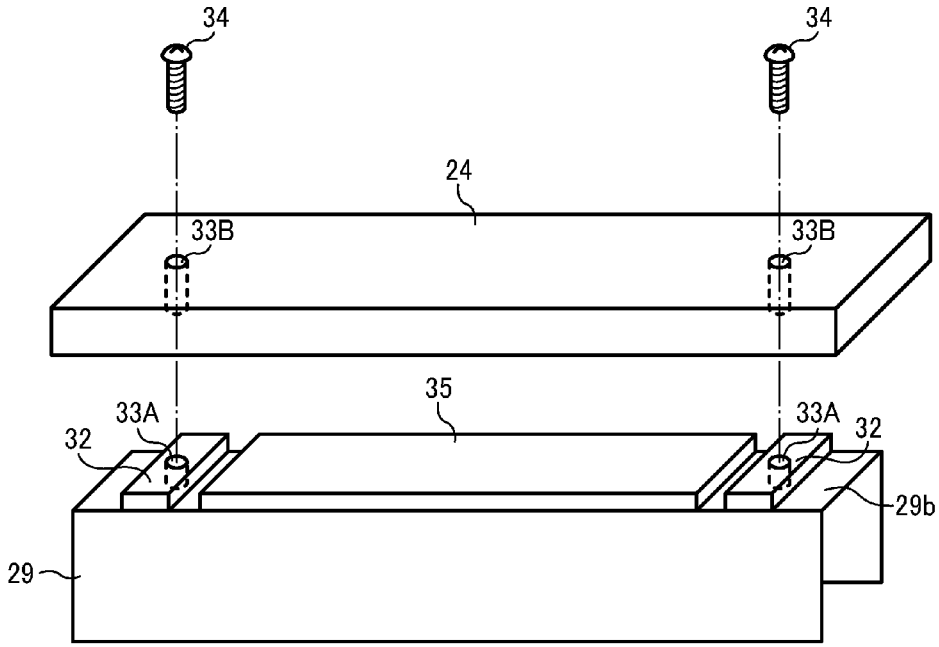
FIG. 5 is a perspective view of a reflector and a reinforcement incorporated in the fixing device shown in FIG. 3 illustrating a second method of attaching the reflector to the reinforcement.

Referring to FIGS. 4 and 5, a detailed description is now given of two methods of attaching the reflector 29 to the reinforcement 24.

FIG. 4 is a perspective view of the reflector 29 and the reinforcement 24 illustrating the first method. As shown in FIG. 4, elastically deformable, two hooks 30 are mounted on an upper face 29*b* of the reflector 29 at each lateral end of the reflector 29 in a longitudinal direction thereof parallel to the axial direction of the fixing belt 21 depicted in FIG. 3. Two recesses 31 are produced in the reinforcement 24 at each lateral end of the reinforcement 24 in a longitudinal direction thereof parallel to the axial direction of the fixing belt 21. The four hooks 30 engage the four recesses 31, respectively, thus attaching the reflector 29 to the reinforcement 24.

FIG. 5 is a perspective view of the reflector 29 and the reinforcement 24 illustrating the second method. As shown in FIG. 5, a resin mount 32 is mounted on the upper face 29*b* of the reflector 29 at each lateral end of the reflector 29 in the longitudinal direction thereof and produced with a first screw hole 33A. A second screw hole 33B is produced in the reinforcement 24 at each lateral end of the reinforcement 24 in the longitudinal direction thereof. As a screw 34 is screwed through the second screw hole 33B of the reinforcement 24 and the first screw hole 33A of the reflector 29 at each lateral end of the reinforcement 24 and the reflector 29 in the longitudinal direction thereof, thus fastening the reflector 29 to the reinforcement 24.

As shown in FIGS. 4 and 5, an insulator 35 is mounted on the upper face 29*b* of the reflector 29. Thus, even if the reflector 29 is attached to the reinforcement 24, the insulator 35 minimizes heat conduction from the reflector 29 to the reinforcement 24.

Figure 6:
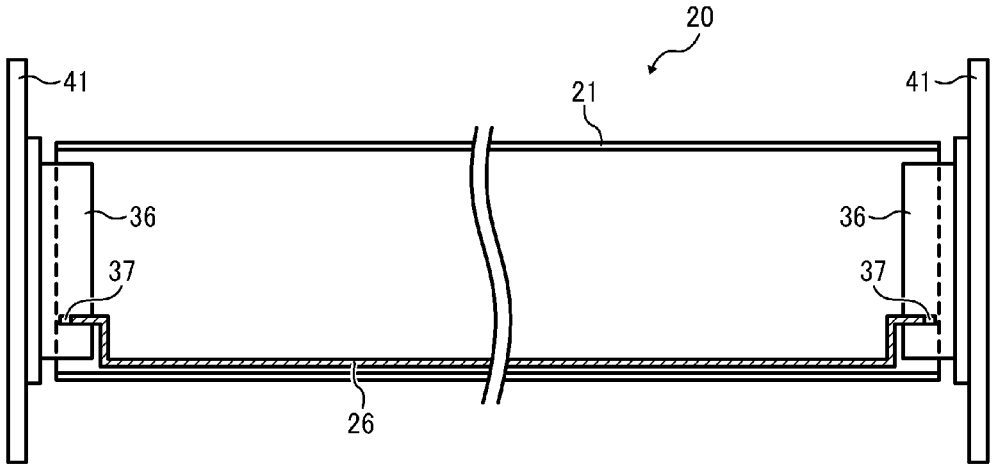
FIG. 6 is a horizontal sectional view of a fixing belt and a heat conductor incorporated in the fixing device shown in FIG. 3.

Referring to FIG. 6, a detailed description is now given of installation of the heat conductor 26.

FIG. 6 is a horizontal sectional view of the fixing belt 21 and the heat conductor 26. As shown in FIG. 6, the heat conductor 26 is mounted on a pair of flanges 36 at each lateral end of the heat conductor 26 in a longitudinal direction thereof parallel to the axial direction of the fixing belt 21. The pair of flanges 36 supports the fixing belt 21 directly or indirectly at both lateral ends of the fixing belt 21 in the axial direction thereof.

Figure 7:
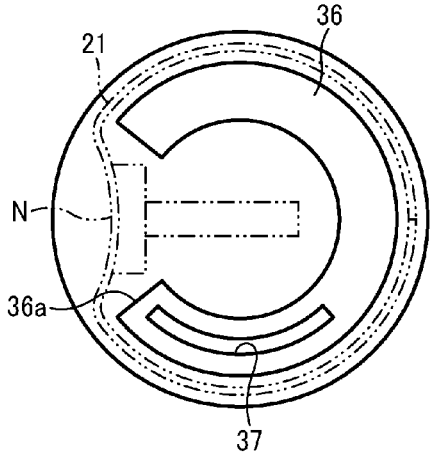
FIG. 7 is a vertical sectional view of a flange incorporated in the fixing device shown in FIG. 3.

An arcuate hole 37 is produced in each flange 36, into which each lateral end of the heat conductor 26 in the longitudinal direction thereof is inserted. Each flange 36 is made of a low thermal conductivity material to minimize heat conduction from the heat conductor 26 to peripheral components through the flange 36. The pair of flanges 36 is mounted on side plates 41 of the fixing device 20, respectively. FIG. 7 is a vertical sectional view of the flange 36. As shown in FIG. 7, the flange 36 is inverse C-shaped with an opening 36*a* that allows deformation of the fixing belt 21 to create the concave fixing nip N shown in the broken line in FIG. 7.

Figure 8:
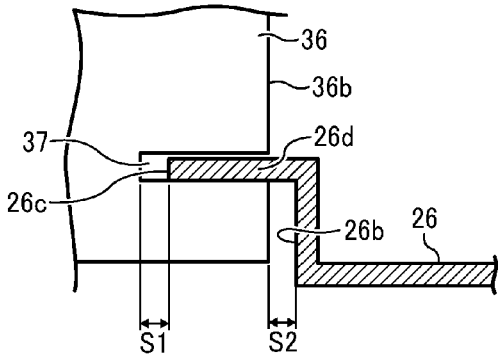
FIG. 8 is a partially enlarged horizontal sectional view of the flange shown in FIG. 7 and the heat conductor shown in FIG. 6.

FIG. 8 is a partially enlarged horizontal sectional view of the flange 36 and the heat conductor 26. As shown in FIG. 8, a first interval Si and a second interval S2 are created between the heat conductor 26 and the flange 36 at one lateral end or both lateral ends of the heat conductor 26 in the longitudinal direction thereof. For example, the heat conductor 26 includes a projection 26d projecting from an opposed face 26*b* of the heat conductor 26. The first interval Si is created between a lateral edge 26c of the projection 26d and a bottom of the hole 37 of the flange 36. The second interval S2 is created between the opposed face 26*b* of the heat conductor 26 and an inner face 36*b* of the flange 36 disposed opposite the opposed face 26*b* of the heat conductor 26. Accordingly, even if the heat conductor 26 thermally expands by heat from the heater 25 depicted in FIG. 3, the first interval S1 and the second interval S2 allow the heat conductor 26 to expand in the longitudinal direction thereof, thus preventing a center of the heat conductor 26 in the longitudinal direction thereof from bending and deforming substantially. The first interval S1 and the second interval S2 are created at one lateral end or both lateral ends of the heat conductor 26 in the longitudinal direction thereof in a state in which both lateral ends of the heat conductor 26 in the longitudinal direction thereof are mounted on the flanges 36, respectively.

Alternatively, the heat conductor 26 may be mounted on components other than the flanges 36. For example, the heat conductor 26 may be secured to the reinforcement 24 depicted in FIG. 3 or the side plates 41 depicted in FIG. 6 indirectly through an intermediate component. The flanges 36 and the intermediate component attached with the heat conductor 26 are made of heat-resistant resin having a glass transition point higher than a given temperature of the heat conductor 26 heated by the heater 25.

Figure 9:
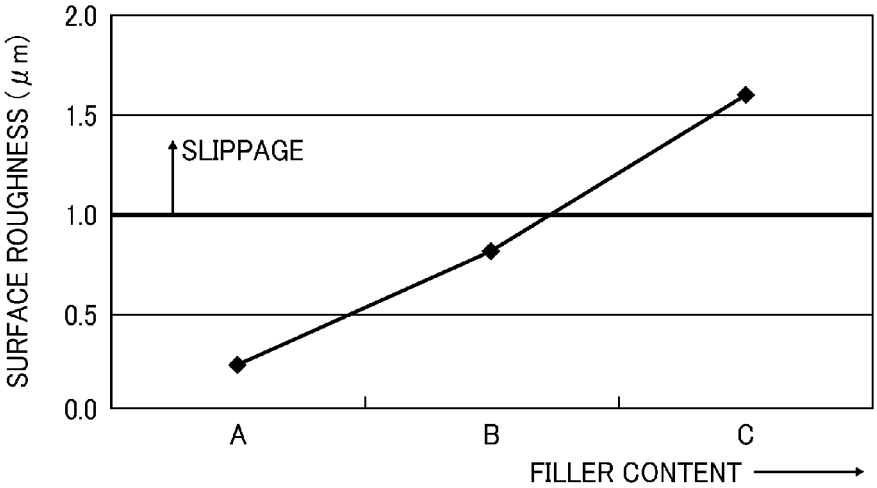
FIG. 9 is a graph showing a relation between a filler content contained in the fixing belt shown in FIG. 6 and a surface roughness of an inner circumferential surface of the fixing belt in a circumferential direction thereof.

FIG. 9 is a graph showing a relation between a filler content contained in the fixing belt 21 and a surface roughness of the inner circumferential surface of the fixing belt 21 in a circumferential direction thereof. As shown in FIG. 9, as the filler content to adjust the thermal conductivity of the fixing belt 21 increases, the surface roughness of the inner circumferential surface of the fixing belt 21 in the circumferential direction thereof increases. The surface roughness of the inner circumferential surface of the fixing belt 21 in the circumferential direction thereof in the graph shown in FIG. 9 is defined by 10-point average roughness RzJIS of Japanese Industrial Standards. When the surface roughness of the inner circumferential surface of the fixing belt 21 in the circumferential direction thereof exceeds about 1.0 micrometer, friction between the nip formation pad 23 and the fixing belt 21 sliding over the nip formation pad 23 and friction between the heat conductor 26 and the fixing belt 21 sliding over the heat conductor 26 increase, causing the fixing belt 21 to slip over the pressing roller 22. To address this circumstance, the filler content is adjusted to a level at which the surface roughness of the inner circumferential surface of the fixing belt 21 in the circumferential direction thereof is not greater than about 1.0 micrometer. Thus, friction between the nip formation pad 23 and the fixing belt 21 and between the heat conductor 26 and the fixing belt 21 decreases, causing the fixing belt 21 to be driven and rotated by the pressing roller 22 without slipping over the pressing roller 22.

As described above with reference to FIG. 3, the heat conductor 26 is not disposed opposite the entire inner circumferential surface of the fixing belt 21 in the circumferential direction thereof, but is disposed opposite a part of the inner circumferential surface of the fixing belt 21 in the circumferential direction thereof. For example, the heat conductor 26 is in contact with or isolation from the second part P2 of the inner circumferential surface of the fixing belt 21 different from the first part P1 thereof contacted by the nip formation pad 23. Accordingly, compared to the configuration shown in FIG. 1 in which the heat conductor 96 is disposed opposite substantially the entire inner circumferential surface of the fixing belt 91 in the circumferential direction thereof, the heat conductor 26 has a substantially decreased heat capacity. The heat conductor 26 is disposed opposite an upstream portion of the fixing belt 21 disposed upstream from the fixing nip N in the rotation direction R2 of the fixing belt 21 where the pressing roller 22 stretches the fixing belt 21 toward the fixing nip N as they rotate. Accordingly, as the pressing roller 22 and the fixing belt 21 rotate, the fixing belt 21 comes into contact with the heat conductor 26, allowing the heat conductor 26 to conduct heat from the heater 25 to the fixing belt 21 effectively. The heat conductor 96 shown in FIG. 1 spans substantially the entire inner circumferential surface of the fixing belt 91 in a circumferential direction thereof including a nip portion of the fixing belt 91 contacted by the nip formation pad 93 where the heat conductor 96 does not heat the fixing belt 91 directly. By contrast, the heat conductor 26 shown in FIG. 3 does not span a nip portion, that is, the first part P1, of the fixing belt 21 contacted by the nip formation pad 23 where the heat conductor 26 does not heat the fixing belt 21 directly. That is, the heat conductor 26 is disposed opposite a portion, that is, the second part P2, of the fixing belt 21 where the heat conductor 26 heats the fixing belt 21 directly, improving heating efficiency for heating the fixing belt 21.

The reflector 29 situated inside the loop formed by the fixing belt 21 reflects light, that is, infrared rays, from the heater 25 toward the heat conductor 26, thus heating the heat conductor 26 effectively. Further, the reflector 29 and the heat conductor 26 surround the heater 25, minimizing dispersion of heat from the heater 25 to peripheral components other than the heat conductor 26 and thereby concentrating heat from the heater 25 onto the heat conductor 26.

With the configuration of the fixing device 20 described above, the heat capacity of the heat conductor 26 is decreased substantially and heat from the heater 25 is concentrated onto the heat conductor 26, allowing the heat conductor 26 to heat the fixing belt 21 effectively, and thus improving heating efficiency for heating the fixing belt 21.

The present invention is not limited to the details of the example embodiments described above, and various modifications and improvements are possible. For example, as shown in FIG. 3, the reflector 29 is provided separately from the reinforcement 24. Alternatively, an outer circumferential surface of the reinforcement 24 may mount a minor that reflects infrared rays from the heater 25 toward the heat conductor 26. Thus, the reinforcement 24 with the mirror surface may serve as a reflector instead of the reflector 29 or a part of the reflector 29.

As shown in FIG. 3, the pressing roller 22 is pressed against the fixing belt 21. Alternatively, the pressing roller 22 may merely contact the fixing belt 21 without pressing against it. According to the example embodiments described above, the pressing roller 22 serves as an opposed rotary body. Alternatively, a pressing belt or the like may serve as an opposed rotary body brought into contact with or pressed against the fixing belt 21. Further, according to the example embodiments described above, the nip formation pad 23 is a stationary pad. Alternatively, a rotary body such as a roller may replace the nip formation pad 23. As shown in FIG. 2, the image forming apparatus 100 is a color laser printer. Alternatively, the image forming apparatus 100 may be a monochrome or other printer, a copier, a facsimile machine, a multifunction printer (MFP) having at least one of copying, printing, facsimile, and scanning functions, or the like.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

an endless belt formed into a loop and rotatable in a first direction;

an opposed rotary body contacting an outer circumferential surface of the belt and rotatable in a second direction counter to the first direction;

a nip formation pad contacting a first part of an inner circumferential surface of the belt and pressing against the opposed rotary body via the belt to form a fixing nip between the belt and the opposed rotary body through which a recording medium bearing a toner image is conveyed;

a heater disposed inside the loop formed by the belt;

a heat conductor disposed opposite a second part of the inner circumferential surface of the belt not contacted by the nip formation pad and interposed between the heater and the belt to conduct heat from the heater to the belt;

a reflector disposed inside the loop formed by the belt and reflecting light from the heater toward the heat conductor; and a reinforcement inside the loop formed by the belt, wherein the reflector is mechanically mounted to the reinforcement via mounts located inside the loop, and the reflector and the heat conductor surround the heater.

2. The fixing device according to claim 1, wherein the second part of the inner circumferential surface of the belt is situated upstream from the fixing nip in the first direction of rotation of the belt where the rotating opposed rotary body stretches the belt toward the fixing nip.

3. The fixing device according to claim 1, wherein the heater generates infrared rays and the reflector is made of a material having an infrared ray reflectance not smaller than about 90 percent.

4. The fixing device according to claim 1, wherein the reflector is disposed opposite the heater in an outer circumferential area of the heater of not smaller than about 180 degrees.

5. The fixing device according to claim 1, wherein the reinforcement is disposed inside the loop formed by the belt to contact and support the nip formation pad and attached with the reflector.

6. The fixing device according to claim 5, further comprising a plurality of hooks mounted on the reflector at both lateral ends of the reflector in a longitudinal direction thereof, wherein the reinforcement includes a plurality of recesses produced at both lateral ends of the reinforcement in a longitudinal direction thereof, the plurality of recesses engaging the plurality of hooks mounted on the reflector.

7. The fixing device according to claim 5, wherein the mounts include, a mount mounted on the reflector at each lateral end of the reflector in a longitudinal direction thereof and produced with a first screw hole;

a second screw hole produced in the reinforcement at each lateral end of the reinforcement in a longitudinal direction thereof; and a screw screwed through the second screw hole of the reinforcement and the first screw hole of the reflector.

8. The fixing device according to claim 5, further comprising an insulator sandwiched between the reinforcement and the reflector.

9. The fixing device according to claim 1, further comprising a pair of flanges contacting both lateral ends of the belt and the heat conductor in an axial direction thereof to support the belt and the heat conductor.

10. The fixing device according to claim 9, wherein the heat conductor includes a projection at each lateral end of the heat conductor in the axial direction thereof and at least one of the pair of flanges includes a hole into which the projection of the heat conductor is inserted, and wherein a first interval is created between a lateral edge of the projection of the heat conductor and a bottom of the hole of the at least one of the pair of flanges.

11. The fixing device according to claim 10, wherein the heat conductor further includes an opposed face mounted to the projection, and the at least one of the pair of flanges includes an inner face disposed opposite the opposed face of the heat conductor with a second interval therebetween.

12. The fixing device according to claim 1, wherein as the belt rotates in the first direction, the inner circumferential surface of the belt contacts an outer surface of the heat conductor in an area not smaller than about 60 percent of the entire area of the outer surface of the heat conductor.

13. The fixing device according to claim 1, wherein the opposed rotary body includes a pressing roller and the heater includes a halogen heater.

14. An image forming apparatus comprising the fixing device according to claim 1.

15. The fixing device according to claim 1, wherein the reflector has three sides facing the heater including a first side, a second side and a third side, the second side being mechanically mounted to the reinforcement.

16. The fixing device according to claim 15, wherein the three sides are folded to create an opening that faces the heat conductor, and an entirety of the heat conductor is interposed between the heater and the belt.

17. The fixing device according to claim 15, wherein edges of the first side and the third side of the reflector contact edges of the heat conductor.

18. The fixing device according to claim 15, wherein the first side, the second side and the third side of the reflector do not overlap the heat conductor.

19. The fixing device according to claim 1, wherein the heat conductor is in a shape of an arc having a curvature corresponding to a curvature of the belt, the arc shaped heat conductor disposed upstream of the fixing nip.

* * * * *